US005842262A

United States Patent [19]

Tietz

[11] Patent Number: 5,842,262

[45] Date of Patent: Dec. 1, 1998

[54] MACHINE FOR MAKING CORNER POSTS

[76] Inventor: Wayne D. Tietz, 1417 Hwy. 18 East, Algona, Iowa 50511

[21] Appl. No.: 608,763

[22] Filed: Feb. 29, 1996

[51] Int. Cl.[6] ..... B21D 39/03

[52] U.S. Cl. ..... 29/429; 29/429

[58] Field of Search ..... 29/787, 429, 772, 29/771, 786, 798, 281.4, 281.5; 227/99, 100, 44, 45, 29, 50, 48, 81

[56] References Cited

U.S. PATENT DOCUMENTS

| | | | |
|---|---|---|---|
| 230,230 | 7/1880 | Brock . | |
| 553,094 | 1/1896 | Becht . | |
| 1,244,986 | 10/1917 | Kitch . | |
| 1,718,571 | 6/1929 | Manny . | |
| 2,649,582 | 8/1953 | Paxton . | |
| 3,733,020 | 5/1973 | Ingram | 227/5 |
| 4,204,624 | 5/1980 | Gunn et al. | 227/45 |
| 4,478,361 | 10/1984 | McElhanon | 227/48 |
| 4,623,083 | 11/1986 | Pagano | 227/152 |
| 4,949,892 | 8/1990 | Neely et al. | 227/44 |

*Primary Examiner*—Carl E. Hall
*Assistant Examiner*—Christopher Goins
*Attorney, Agent, or Firm*—Zarley, McKee, Thomte, Voorhees & Sease

[57] ABSTRACT

A machine and method are provided for manufacturing corner posts for protecting products loaded onto pallets, and to provide structural support to permit loaded pallets to be stacked one upon another. The machine includes a continuously moving conveyor which moves a pair of boards from a pick-up station, through a fastening station and to a drop-off station. The boards are stapled or nailed together on the fly by a pneumatic gun which is periodically activated to install a series of staples or nails into the overlapped boards. A hopper holds the individual boards and drops them onto an inverted V-shaped support track through which the conveyor moves. The boards are ramped into overlapping engagement with one another and then stapled or nailed together as they move continuously along the support track.

32 Claims, 8 Drawing Sheets

MACHINE FOR MAKING CORNER POSTS

BACKGROUND OF THE INVENTION

Many products are shipped and stored on pallets. Typically, such products are placed on a pallet, which is moved by fork lifts. While some products are boxed before loading on a pallet, other products are placed on the pallet without protection. Such boxed and unprotected products are subject to damage during transport, and even during storage when other pallet loads are moved into adjacent positions.

It is also desirable, at times, to stack pallet loads one upon another to save floor space. However, some products do not have the structural strength to support additional loads.

Therefore, a primary objective of the present invention is the provision of a machine which can quickly and simply mass produce corner posts for protecting pallet loads from damage.

Another objective of the present invention is the provision of a machine for making corner posts which provide structural stability to pallet loads such that loaded pallets can be stacked one upon another.

A further objective of the present invention is a method of manufacturing corner posts quickly, efficiently and safely.

Another objective of the present invention is the provision of a machine and method for making corner posts requiring minimal manual labor.

These and other objectives will become apparent from the following description of the invention.

SUMMARY OF THE INVENTION

The corner post machine of the present invention quickly and efficiently mass produces corner posts for use with pallet loads, with a minimum of manual labor. The corner posts are formed from a pair of boards which are stapled or nailed together at right angles to one another along their lengths. The machine includes a board pick-up station, a board fastening or securing station, and a corner post drop-off station. A conveyor moves the board from the pick-up station, through the securing station, and to the drop-off station without manual handling.

The machine includes a V-shaped hopper or magazine having opposite sides into which the separate boards are loaded. The hopper drops the board onto an inverted V-shaped track so as to orient the boards at right angles to one another. A continuously moving conveyor chain extends through the track and carries the boards to the securing station wherein a staple or nail gun automatically inserts a plurality of staples or nails into the boards so as to form the corner posts. The gun is actuated by a plurality of sensors or switches which sense the position of the boards as they are moved along the conveyor. A roller stamp places an identifying mark on the corner posts, which are then deposited on the drop-off station.

The method of the present invention involves the steps of loading the individual boards into the hopper. The conveyor is actuated to periodically pick up a pair of boards from the hopper and move the boards along the track to the securing station, wherein nails or staples are automatically driven into the boards to form the corner posts. The conveyor then moves the corner posts past the roller stamp for marking and deposits the finished corner posts at the drop-off station. The conveyor moves continuously and the boards do not stop during the stapling or nailing operation or during the stamping operation. Sensors are provided to shut off the conveyor if the hopper runs out of boards or if the gun runs out of staples or nails.

DETAILED DESCRIPTION OF THE DRAWINGS

Figure 1:
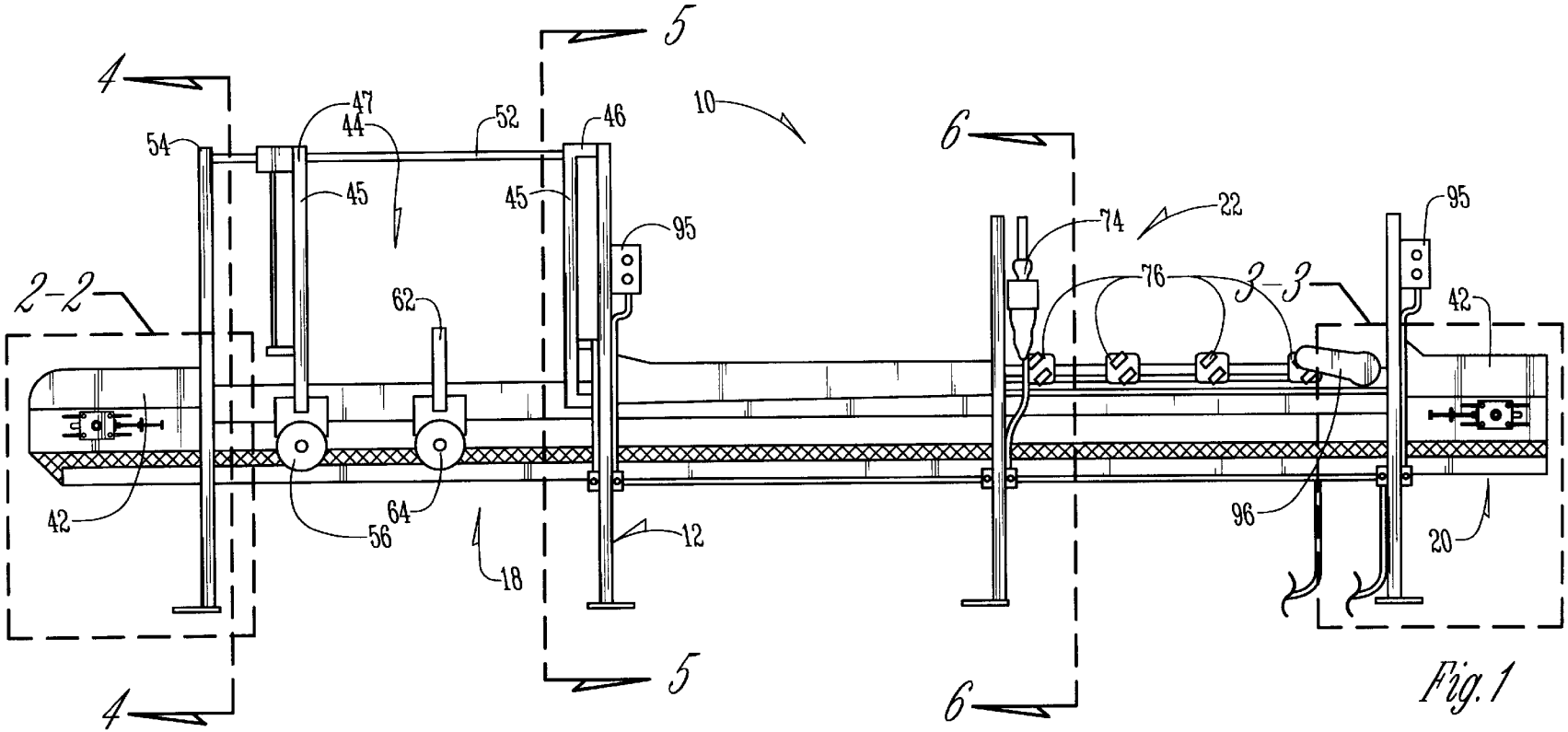
FIG. 1 is a side elevation view of the corner post machine of the present invention.
Figure 2:
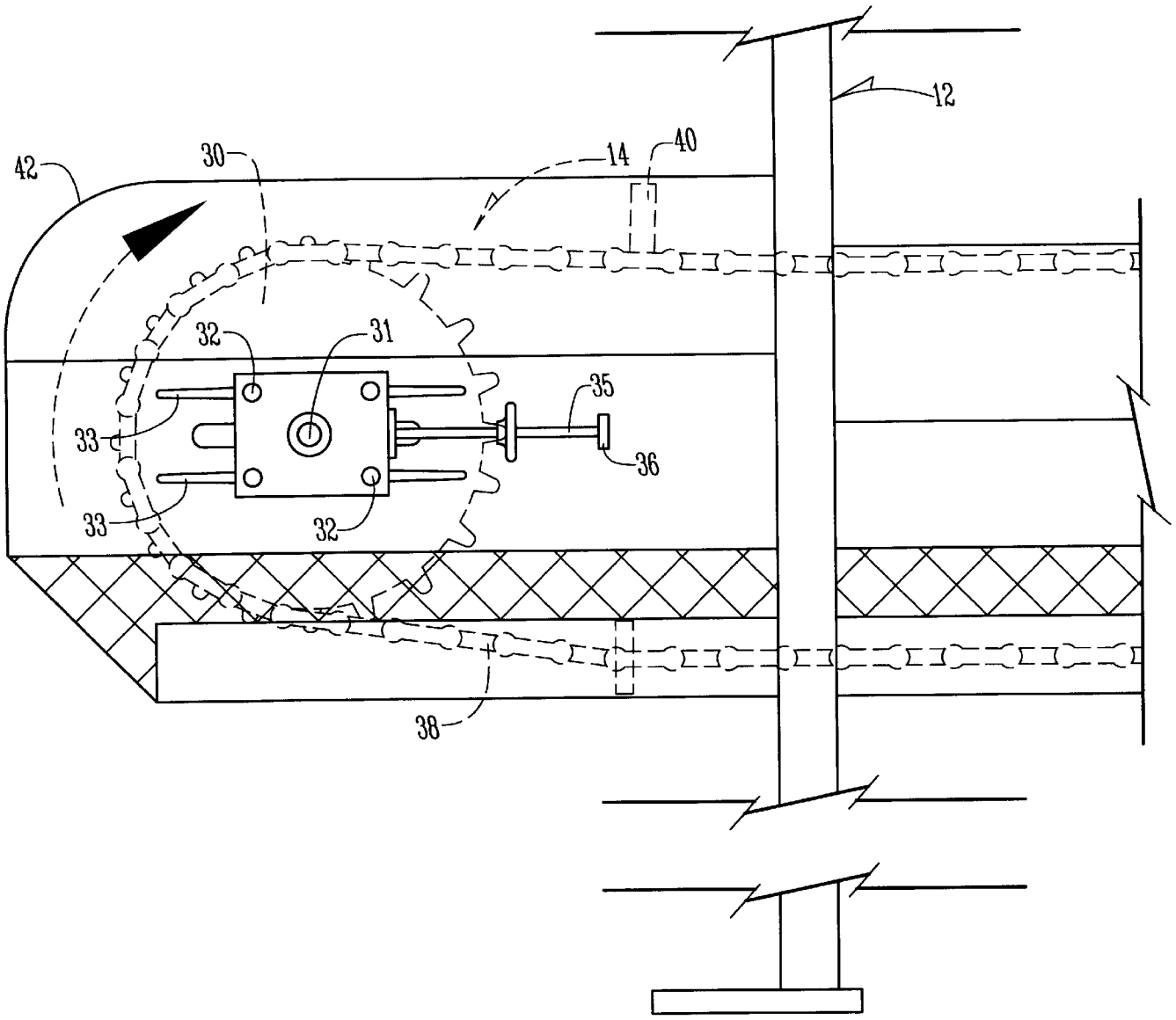
FIG. 2 is an enlarged elevation view taken along lines 2—2 of FIG. 1.
Figure 3:
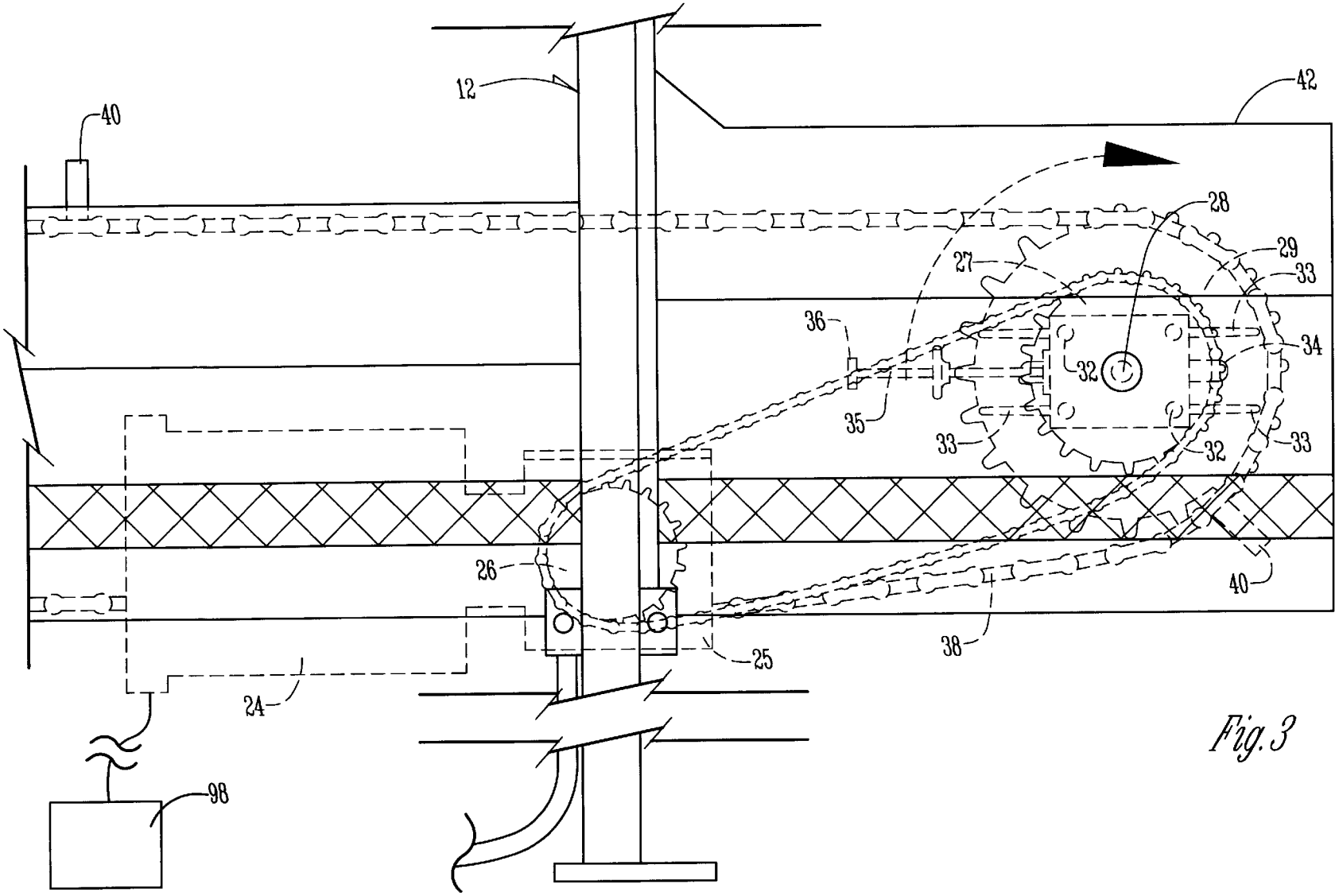
FIG. 3 is an enlarged elevation view taken along lines 3—3 of FIG. 1.
Figure 4:
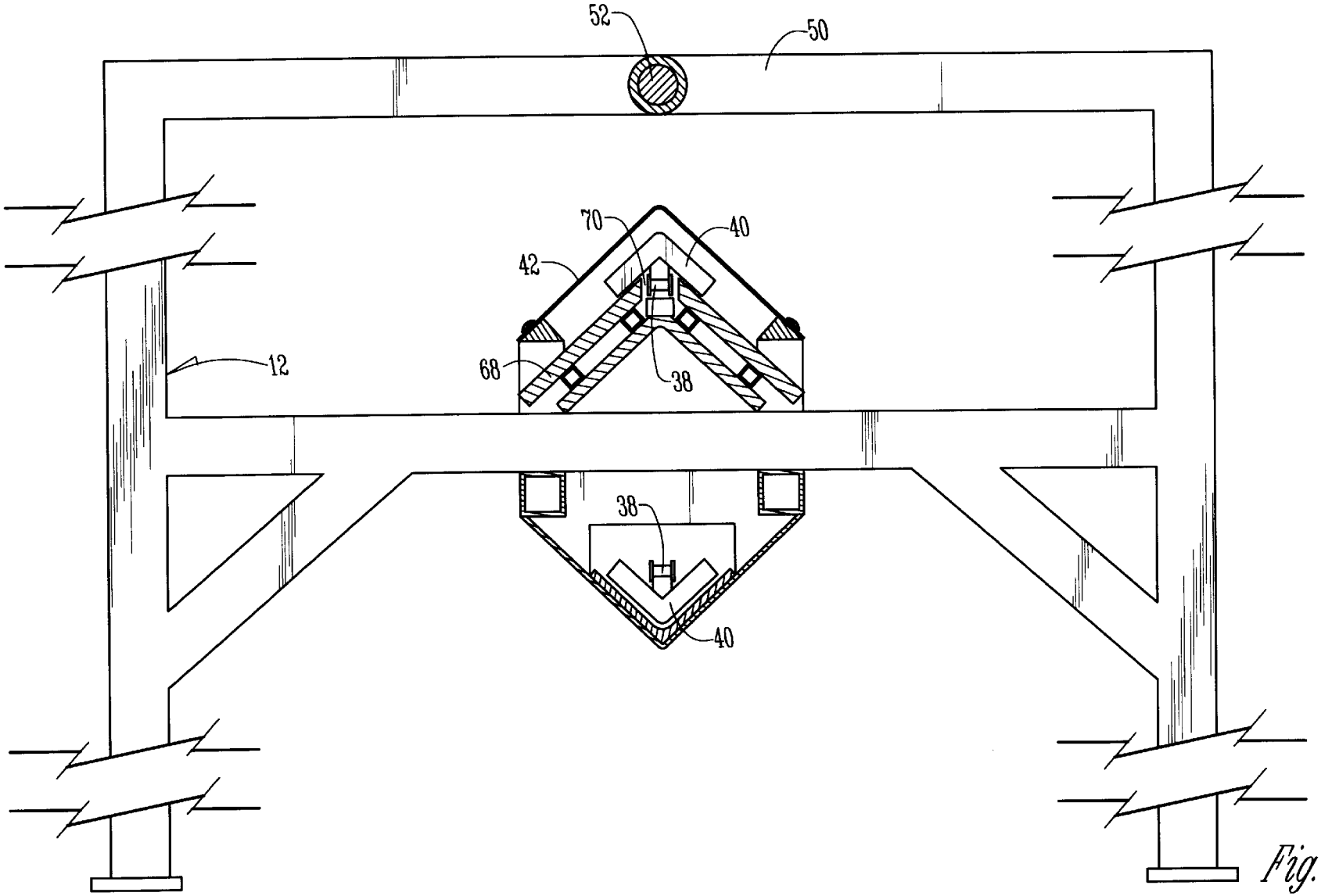
FIG. 4 is a sectional view taken along lines 4—4 of FIG. 1.
Figure 5:
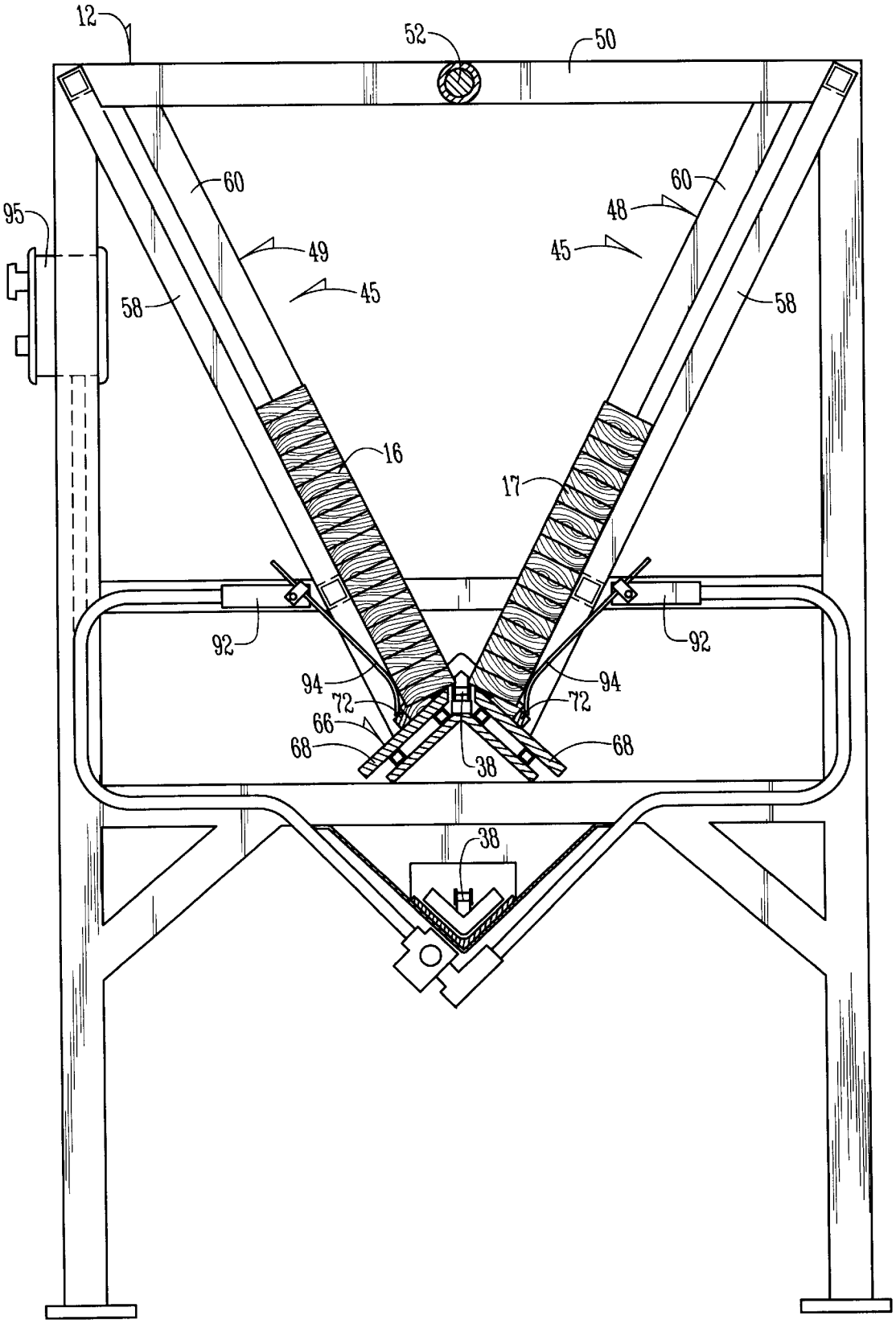
FIG. 5 is a sectional view taken along lines 5—5 of FIG. 1.
Figure 6:
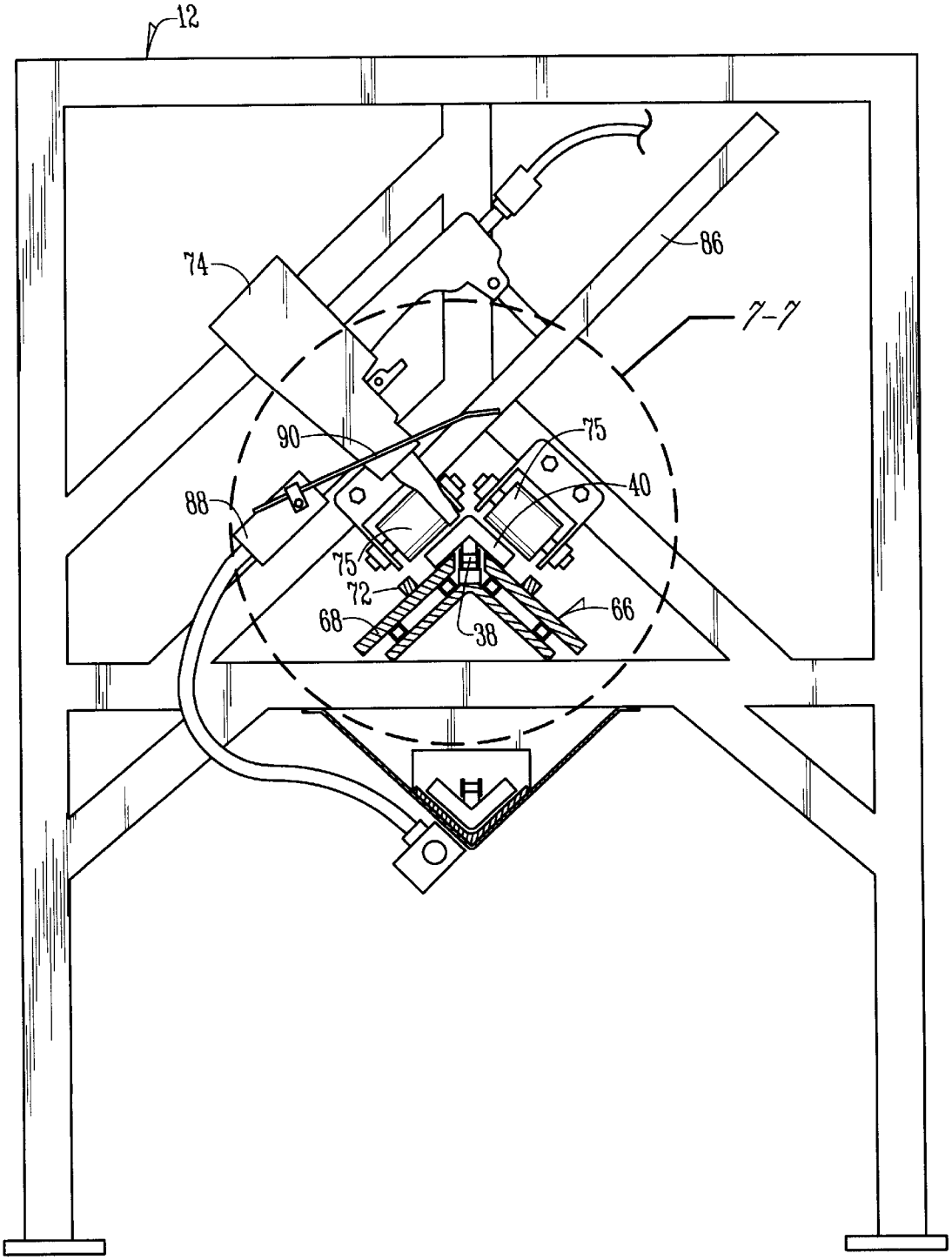
FIG. 6 is a sectional view taken along lines 6—6 of FIG. 1.
Figure 7:
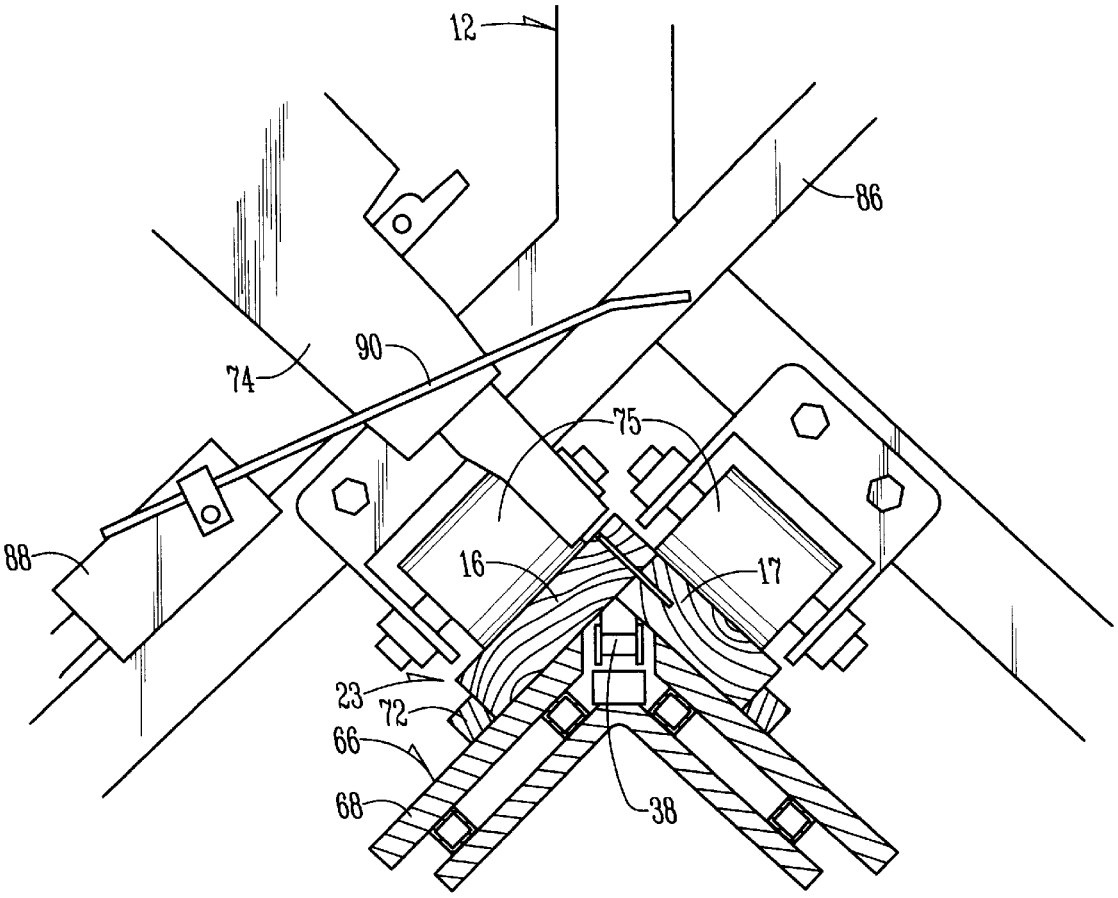
FIG. 7 is an enlarged view taken along lines 7—7 of FIG. 6.

With reference to the drawings, the machine for making corner posts according to the present invention is generally designated by the reference numeral 10. The corner post machine 10 includes a frame 12 and a conveyor 14. The conveyor 14 is adapted to move a pair of first and second boards 16, 17, respectively, along the length of the machine 10, from a pick-up station 18 to a drop-off station 20. Between the pick-up station 18 and the drop-off station 20, there is a fastening or securing station 22 wherein the boards are attached to one another at substantially right angles so as to form a corner post 23.

The conveyor 14 includes a motor 24 mounted on the frame 12. An example of a suitable motor is a Baldor electric motor cat. #VM 3548, 1 horsepower, 3 phase, frame 56C. A gear reduction box 25, such as Baldor #000003540C, is operatively connected to the motor 24. A preferred reduction ratio is 30 to 1. The motor drive speed is further reduced with a sprocket and chain assembly, including a small sprocket 26 on the reduction box 25, and a larger sprocket 27 on a main drive axle 28. A conveyor drive sprocket 29 is mounted on the axle 28 and a conveyor idler sprocket 30 is mounted on an axle 31 at the opposite end of the machine 10.

The sprockets 29, 30 are adjustably mounted on the frame 12 through a plurality of bolts 32 extending through elongated slots 33 in the sprockets. The axles 28, 31 are also mounted in slots 34 such that the sprockets are slidably adjustable. A threaded shaft 35 is threadably mounted on the frame 12 adjacent each sprocket 29, 30, and includes a knob 36. The knob 36 can be turned to advance the shaft 35 when the sprocket bolts 32 are loosened, thereby sliding the respective sprocket 29, 30 to a desired position. The bolts 32 are then tightened to maintain the sprockets in the desired position.

The conveyor 14 also includes a drag chain 38 trained about the sprockets 29, 30. The chain 38 includes a plurality of pick-up fingers 40, each of which pick up a pair of the boards 16, 17 and move the boards from the pick-up station 18 to the drop-off station 20, as described further below. Preferably, the fingers are spaced approximately 5 feet apart along the chain 38. A housing or guard 42 covers the sprockets for operator safety.

The machine 10 includes a magazine or hopper 44 for holding the individual boards 16, 17. The hopper 44 includes opposite ends 46, 47 and opposite sides 48, 49. The sides 48–49 extend outwardly from bottom to top such that the hopper 44 has a V-shape. One end 46 of the hopper is fixed, while the opposite end 47 is adjustable with respect to the first end 46. The movable end 47 includes an upper cross bar 50 extending between the opposite upper ends of the sides 48, 49. A slide bar 52 extends through an aperture in the cross bar 50, and is supported at one end by the fixed end 46 of the hopper 44 and at the opposite end by a frame extension 54. Thus, the movable end 47 is slidable along the bar 52 so that the spacing between the hopper ends 46, 47 can be adjusted to accommodate boards 16, 17 of varying lengths. Accordingly, corner posts having different lengths or heights can be made by the machine 10.

The movement of the end 47 of the hopper 44 is controlled by any convenient means. In the drawings, a hand crank 56 is shown, and is operatively connected to a toothed gear wheel (not shown) which is in meshing combination with a toothed gear track (not shown), such that rotation of the hand crank 56 moves the gear wheel along the gear track to move the end 47 of the hopper along the frame 12. Alternatively, the hand crank can be coupled to a worm gear assembly to adjust the position of the hopper end 47.

Each leg 45 of the hopper 44 includes a side member 58 and end member 60. The side member 58 of the leg 45 engages one side of the associated board 16, 17, while the end members 60 of the legs 45 prevent the boards from moving longitudinally within the hopper 44.

The hopper 44 also includes a pair of short arms 62 which are angularly disposed in an orientation parallel with the legs 45 of the hopper 44. The arms 62 are movable along the hopper 44 via a hand crank 64, in a manner similar to that described above with respect to the movable end 47.

An inverted V-shaped support track 66 is provided beneath the hopper 44. The track 66 includes opposite sides 68 which are disposed at substantially 90° with respect to one another, and which are spaced apart at the apex of the V so as to define a slot 70 therebetween. Each pair of boards 16, 17 drop by gravity from the hopper 44, one pair at a time, onto the support track 66. The pick-up fingers 40 of the conveyor 14 extend through the slot 70 of the track 66 so as to engage the rearward end of the boards 16, 17 and thereby slide the boards along the track 66. The arms 62 function to prevent the boards 16, 17 from sliding downward upon the track 66 as the pickup fingers 40 move the boards away from the end 47 of the hopper. The inner surfaces of the arms 62 are spaced outwardly from the inner surfaces of side members 58 of the hopper legs 45, so as to avoid interference as the boards 16, 17 drop downwardly within the hopper 44. A ramp 72 is provided on each side 68 of the track 66. As the boards 16, 17 move along the track 66, the ramps 72 move the boards into engagement with one another, in a 90° orientation, so as to be ready for fastening.

A pneumatic staple or nail gun 74 is mounted to the frame 12 in the securing or fastening station 22. A preferred staple gun is manufactured by Duo Fast, model no. DS 7664/SP328A. As the boards 16, 17 are moved through the securing station 22 by the fingers 40 of the conveyor 14, the gun 74 is periodically actuated to install a series of staples or nails into the overlapped boards so as to secure the boards together. A plurality of retainer wheels or rollers 75 are provided on each side of the support track 66 adjacent the stapler nail gun 74 so as to maintain the position of the boards 16, 17 on the track 66 as the boards pass through the fastening station 22.

Figure 8:
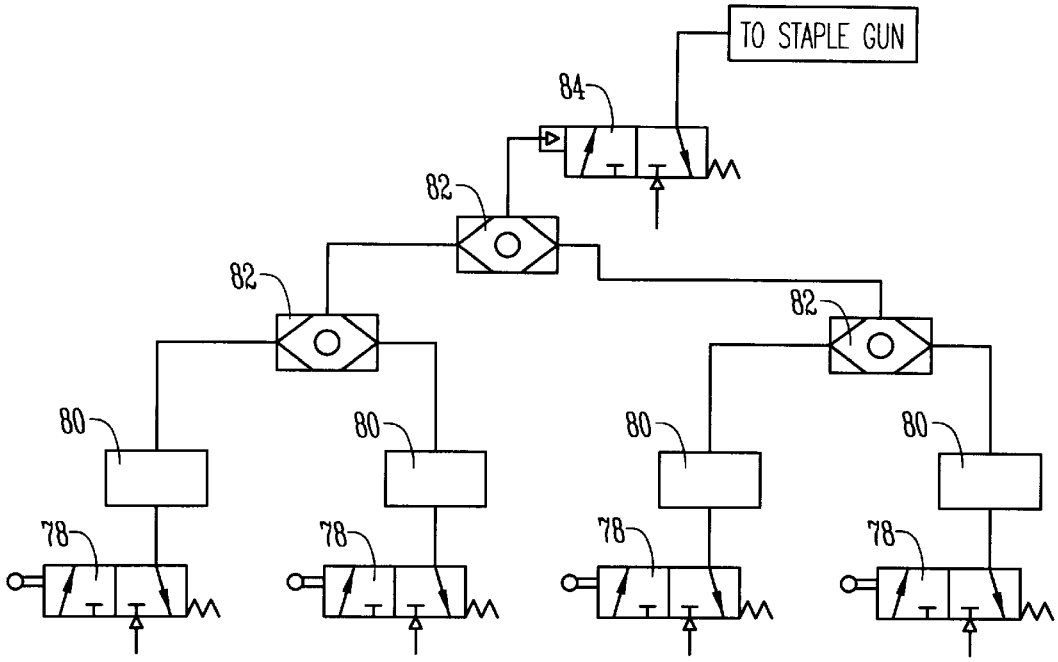
FIG. 8 is a schematic diagram showing the pneumatic circuitry for the pneumatic staple gun and actuating switches.

The periodic actuation of the gun is controlled by a series of sensors 76. Each sensor 76 includes a lever roller cam switch 78 and a one-shot pulse valve 80. A plurality of shuttle values 82 are provided for the sensors 76, along with an air pilot valve 84. The pilot valve 84 is operatively connected to the pneumatic gun 74. Thus, each time the leading edge of one of the boards 16, 17 trips a lever switch 78, the gun 74 is actuated to shoot a staple or nail into the boards. A pneumatic schematic of the switches 78, and valves 80, 82, 84 is shown in FIG. 8

One example of a useful lever roller cam switch 78 is a Norgren switch model no. MH12BDA-32-B001. An example of the one shot pulse valve 80 is valve model no. OS-1 manufactured by Fabco. A suitable shuttle valve is model no. S125 manufactured by Humphrey, and an acceptable pilot valve 84 is a Humphrey model no. 125A-3-11-21.

Figure 9:
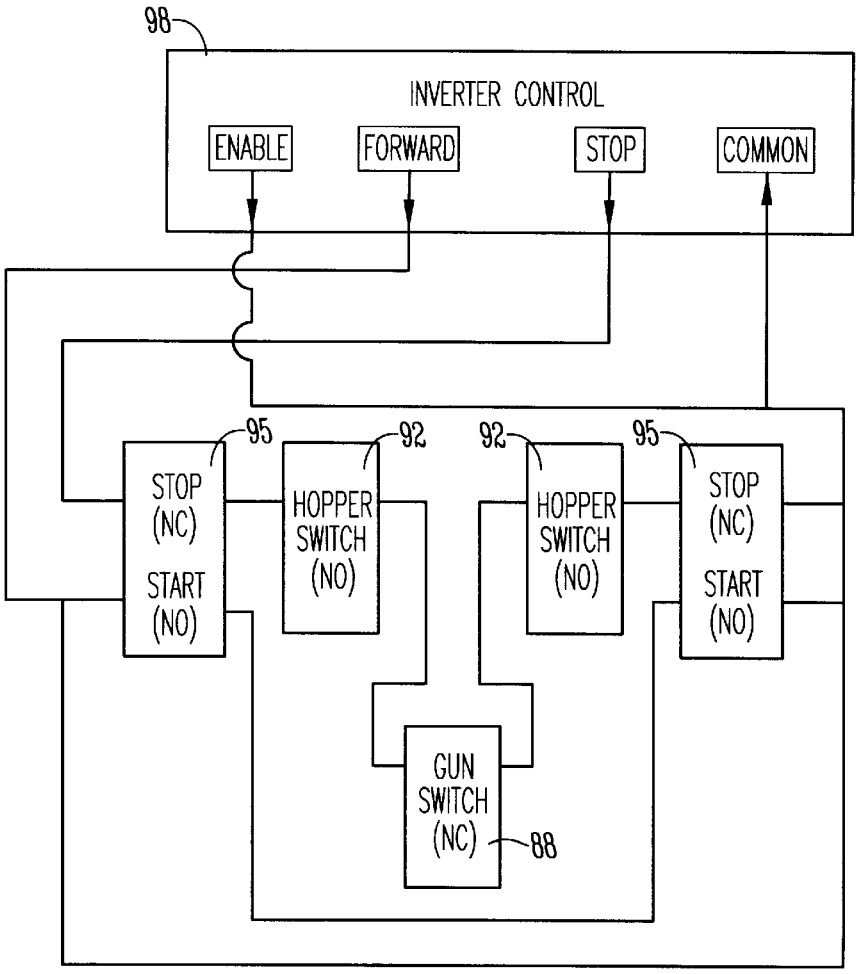
FIG. 9 is an electrical schematic diagram of the on/off switches for the machine.

A staple or nail magazine 86 is mounted on the frame 12 and operatively connected to the gun 74. A staple or nail sensor 88 is mounted adjacent the magazine 86. The sensor 88 includes a spring-biased sensor finger 90. The finger 90 normally engages the staples or nails in the magazine 88. When the remaining staples or nails in the magazine 88 reaches a predetermined level, or the magazine 86 is empty, the finger 90 is free to pivot and thereby actuate a switch in the sensor 88 which turns off the machine 10. A similar sensor 92 with a spring biased finger 94 is provided for each side 48, 49 of the board hopper 44. The fingers 94 normally engage the boards in the hopper 44. When one side of the hopper 44 becomes empty of boards, the finger 94 pivots to activate a switch in the sensor 92 and thereby shuts off the machine 10 until additional boards are loaded into the empty side of the hopper 44. One example of suitable sensors 88, 92 is manufactured by Cutler Hammer, model no. ESO, single pole double throw limit switch. On/off switches 95 are also mounted at each end of the machine 10 so that an operator can quickly and easily manually shut off the machine in the event of an emergency or other need to stop the machine. An electrical schematic of the sensors 88, 92 and switches 95 is shown in FIG. 9.

A stamp roller 96 is provided adjacent the downstream end of the conveyor 14. A suitable stamp roller 96 is commercially available from Coder's Corp. under the KIWI trademark model no. 450. The stamp roller 96 includes self inking wheel suitable to place an identifying part number or code on the corner post 23.

After the boards 16, 17 are fastened and stamped, the conveyor 14 deposits the corner posts 23 in the drop-off station 20 at the end of the conveyor 14. The corner posts 23 can then be manually moved or further conveyed to a desirable location.

In operation, the individual boards 16, 17 are manually loaded into each side of the hopper 44. The machine 10 is turned on to start the conveyor 14 and activate the electrical and pneumatic systems. One board 16, 17 from each side 48, 49 of the hopper 44 is dropped unto the support track 66 beneath the hopper 44. As the conveyor chain 38 rotates around the sprockets 29, 30, each finger 40 picks up a set of boards 16, 17 and moves the boards along the track 66 to the securing station 22. Prior to reaching the securing station, the boards 16, 17 are ramped by the ramps 72 into abutting engagement. As the boards 16, 17 move downstream from the hopper 44, the next set of boards 16, 17 drop onto the support track 66 for engagement by the next pick-up finger 40 on the chain 38.

The boards 16, 17 are carried through the securing station 22 by the conveyor chain 38, such that the leading edge of one of the boards sequentially activates each lever roller cam switch 78 of the sensors 76, thereby periodically actuating the gun 74 to install a staple or nail into the boards. The boards then move into engagement with the stamp roller 96 which places the parts number on one of the boards. The completed corner post 23 is then deposited by the conveyor chain 38 onto the drop-off station 20 at the end of the conveyor 14.

An important feature of the present invention is the continuous movement of the boards 16, 17 from the pick-up station 18 to the drop-off station 20. The boards do not stop for stapling or nailing. Rather, the boards 16, 17 are fastened on the fly or run. Thus, a very high speed operation can be maintained. Preferably, the conveyor 14 is driven at approximately 75 feet per minute. The speed of the conveyor is adjustable via a motor speed control member 98 operatively connected to the motor 24. One example of a control member 98 for the machine 10 is a Baldor 15H Inverter Control, which provides numerous control functions. Preferably, the boards 16, 17 are 1"×4". The boards 16, 17 are preferably 4 feet long, but other lengths may be accommodated by the machine 10. With 4 feet boards, and the chain running at an optimum 75 feet per minute, 15 corner posts can be manufactured per minute. The conveyor 14 can be safely run between 60–90 feet per minute. Thus, the machine 10 quickly, simply and efficiently mass produces the corner posts.

It is understood that the orientation of the boards 16, 17 with respect to one another can be varied so as to produce fastened overlapping boards, other than corner posts wherein the boards are disposed at 90° with respect to one another. The disposition of the sides of the support track 66 would accordingly be modified to accommodate the desired overlapping and angular relationship of the boards to produce a different finished product. Such different finished products could be manufactured with a modified hopper 44 and track 66, while maintaining the continuously moving conveyor 14.

Whereas the invention has been shown and described in connection with the preferred embodiments thereof, it will be understood that many modifications, substitutions, and additions may be made which are within the intended broad scope of the following claims. From the foregoing, it can be seen that the present invention accomplishes at least all of the stated objectives.

What is claimed is:

1. A machine for making corner posts by securing first and second elongated boards together along overlapped portions of the boards, the machine comprising:

a track for supporting the first and second boards in an overlapping orientations such that the first board overlaps the second board along substantially the entire length of the first board;

a conveyor for moving the overlapped boards together along the track; and a securing station for securing the overlapped boards together to form a corner post.

2. The machine of claim 1 further comprising first and second hoppers to hold the first and second boards, respectively, and to deposit the first and second boards onto the track.

3. The machine of claim 1 wherein the track has opposite spaced apart first and second sides, the first side supporting the first board and the second side supporting the second board, the conveyor extending between the opposite sides.

4. The machine of claim 3 wherein the first and second sides of the track are disposed 90° with respect to one another.

5. The machine of claim 3 wherein at least one of the first and second sides of the track has a ramp to raise the respective board into overlapping orientation with the other board prior to the securing station.

6. The machine of claim 1 wherein the conveyor moves continuously as the boards are secured in the securing station.

7. The machine of claim 1 wherein the track supports the boards in a longitudinally parallel orientation.

8. The machine of claim 1 wherein the conveyor includes a plurality of spaced apart pick-up fingers each being adapted to engage a set of first and second boards for movement along the track.

9. A machine for securing first and second elongated boards together, the machine comprising:

a conveyor for continuously moving the first and second boards from a pick-up station to a drop-off station, the boards being unsecured at the pick-up station and secured together at the drop-off station;

a securing station between the pick-up and drop-off stations for securing the first and second boards together as the boards move continuously through the securing station;

a track for supporting the boards during movement from the pick-up station, through the securing station, and to the drop-off station;

the track having opposite spaced apart sides, with each side supporting one of the boards and the conveyor extending between the opposite sides;

the opposite sides of the track being disposed substantially 90° from one another such that the boards are supported at a substantially 90° orientation with respect to one another for securement so as to form a corner post.

10. The machine of claim 9 further comprising a hopper adjacent the pick-up station for holding a plurality of boards for pickup by the conveyor at the pick-up station.

11. The machine of claim 10 wherein the hopper is V-shaped with opposite sides, with each side adapted to hold a plurality of boards.

12. The machine of claim 9 wherein the track includes a ramp on each side, the ramps cooperating to raise the first and second boards to an overlapped orientation prior to the securing station.

13. The machine of claim 9 further comprising a V-shaped hopper with opposite sides mounted above the track, with each side adapted to hold a plurality of boards for individual placement on the respective sides of the track.

14. The machine of claim 9 wherein the securing station includes a staple gun for inserting staples into the boards to secure the boards together.

15. The machine of claim 14 wherein the securing station includes a plurality of sensors for periodically actuating the staple gun to insert a series of staples along the lengths of the boards.

16. The machine of claim 14 wherein the conveyor includes an endless loop chain with a plurality of spaced apart pick-up fingers, each finger being adapted to engage a set of first and second boards for movement to the drop-off station.

17. The machine of claim 9 further comprising a roller stamp between the pick-up and drop-off stations for applying a mark to one of the boards.

18. A machine for securing first and second elongated boards together, the machine comprising:

a conveyor for continuously moving the first and second boards from a pick-up station to a drop-off station, the boards being unsecured at the pick-up station and secured together at the drop-off station;

a securing station between the pick-up and drop-off stations for securing the first and second boards together as the boards move continuously through the securing station;

a track for supporting the boards during movement from the pick-up station, through the securing station, and to the drop-off station;

the track having opposite spaced apart sides, with each side supporting one of the boards and the conveyor extending between the opposite sides;

the track comprising a ramp on each side, the ramps cooperating to raise the first and second boards to an overlapped orientation prior to the securing station.

19. The machine of claim 18 further comprising a hopper adjacent the pick-up station for holding a plurality of boards for pickup by the conveyor at the pick-up station.

20. The machine of claim 18 wherein the hopper is V-shaped with opposite sides, with each side adapted to hold a plurality of boards.

21. The machine of claim 18 wherein the opposite sides of the track are disposed substantially 90° from one another such that the boards are supported at a substantially 90° orientation with respect to one another for securement so as to form a corner post.

22. The machine of claim 18 further comprising a V-shaped hopper with opposite sides mounted above the track, with each side adapted to hold a plurality of boards for individual placement on the respective sides of the track.

23. The machine of claim 18 wherein the securing station includes a staple gun for inserting staples into the boards to secure the boards together.

24. The machine of claim 18 wherein the securing station includes a plurality of sensors for periodically actuating the staple gun to insert a series of staples along the lengths of the boards.

25. The machine of claim 18 wherein the conveyor includes an endless loop chain with a plurality of spaced apart pick-up fingers, each finger being adapted to engage a set of first and second boards for movement to the drop-off station.

26. A machine for securing first and second elongated boards together, the machine comprising:

a conveyor for continuously moving the first and second boards from a pick-up station to a drop-off station, the boards being unsecured at the pick-up station and secured together at the drop-off station;

a securing station between the pick-up and drop-off stations for securing the first and second boards together as the boards move continuously through the securing station;

a track for supporting the boards during movement from the pick-up station, through the securing station, and to the drop-off station;

a V-shaped hopper with opposite sides mounted above the track, with each side adapted to hold a plurality of boards for individual placement on the respective sides of the track.

27. The machine of claim 26 wherein the track has opposite spaced apart sides, with each side supporting one of the boards and the conveyor extending between the opposite sides.

28. The machine of claim 26 wherein the opposite sides of the track are disposed substantially 90° from one another such that the boards are supported at a substantially 90° orientation with respect to one another for securement so as to form a corner post.

29. The machine of claim 26 wherein the track includes a ramp on each side, the ramps cooperating to raise the first and second boards to an overlapped orientation prior to the securing station.

30. The machine of claim 26 wherein the securing station includes a staple gun for inserting staples into the boards to secure the boards together.

31. The machine of claim 26 wherein the securing station includes a plurality of sensors for periodically actuating the staple gun to insert a series of staples along the lengths of the boards.

32. The machine of claim 26 wherein the conveyor includes an endless loop chain with a plurality of spaced apart pick-up fingers, each finger being adapted to engage a set of first and second boards for movement to the drop-off station.

* * * * *